US005394808A

United States Patent [19]

Dutro et al.

[11] Patent Number: 5,394,808

[45] Date of Patent: Mar. 7, 1995

[54] FOLDING TABLE CONSTRUCTION AND METHOD OF FABRICATION

[75] Inventors: William A. Dutro, Emeryville, Calif.; Craig Wallin, Logan, Utah

[73] Assignee: Dutro Company, Emeryville, Calif.

[21] Appl. No.: 888,257

[22] Filed: May 22, 1992

Related U.S. Application Data

[63] Continuation of Ser. No. 605,087, Oct. 29, 1990, abandoned.

[51] Int. Cl.[6] ..... A47B 3/08

[52] U.S. Cl. ..... 108/126; 248/439; 403/353; 108/130; 108/129

[58] Field of Search ..... 108/157, 159, 129, 27, 108/130, 131; 248/289, 290, 439, 188; 403/353, 388

[56] References Cited

U.S. PATENT DOCUMENTS

| | | | |
|---|---|---|---|
| 2,459,529 | 1/1949 | Jogwick et al. | 108/130 X |
| 3,190,596 | 6/1965 | Kaminky | 108/130 X |
| 3,319,958 | 5/1967 | Bender | 108/131 X |
| 3,349,728 | 10/1967 | Barecki et al. | 108/131 |
| 3,366,079 | 1/1968 | Koransky et al. | 108/157 |
| 4,064,815 | 12/1977 | Baum | 108/129 |
| 4,383,488 | 5/1983 | Macho et al. | 108/129 |
| 4,561,622 | 12/1985 | Heinzel | 248/439 |
| 4,570,410 | 2/1986 | Tuneke et al. | 108/27 |

*Primary Examiner*—Peter A. Aschenbrenner
*Attorney, Agent, or Firm*—Harris Zimmerman

[57] ABSTRACT

A folding table has a unitary table top formed of molded plastic preferably having an outer shell of non-cellular plastic with a filling of light weight hardened foam. Pairs of spaced apart sockets are formed in the table top material at the underside of the table top and a cylindrical bushing is disposed in each socket. One of a pair of pivotable leg assemblies is coupled to each pair of sockets by a pair of pivot axle projections that extend into the sockets and bushings. At least one of the sockets of each pair has a depth at least equal to the combined distances that the pivot axle projections extend into the pair of sockets. This enables entry of the pair of pivot axle projections into the pair of sockets by inserting one of the projections deeply into the one socket and then partially withdrawing that projection while guiding the other projection into the other socket of the pair. Table assembly is simplified as the legs are coupled directly to the table top without requiring installation of hinges or similar hardware.

11 Claims, 2 Drawing Sheets

FOLDING TABLE CONSTRUCTION AND METHOD OF FABRICATION

CROSS REFERENCE TO RELATED APPLICATION

This is a continuation of application Ser. No. 07/605,087, having the same title and which was filed on Oct. 29, 1990, now abandoned.

TECHNICAL FIELD

This invention relates to furniture and more particularly to tables of the type having a table top and support legs that can be pivoted up into a substantially parallel relationship with the table top when the table is not in use.

BACKGROUND OF THE INVENTION

Folding tables with pivotable legs are advantageous for many purposes as the bulk of the table can be greatly reduced when it is to be stored away or transported from one location to another. Such tables are typically used in situations where tables need to be set up only temporarily although folding tables may also be used on a continuing basis.

Wood or metal table tops require installation of hinges or other similar hardware fixtures in order to form a pivotable coupling between the support legs and the table top. This involves emplacement of a number of screws or other fasteners. Such operations complicate and slow the assembly of such tables and thus add significantly to the costs of manufacturing the tables.

The conventional hinge couplings or the like also often result in an undesirable weak and unreliable attachment of the support legs to the table top. Conventional folding tables frequently display a lack of rigidity and tend to be subject to malfunction and breakage in the region of the pivot couplings. Efforts to relieve these problems by providing a more massive construction, stronger hardware and more screws or other fasteners further increase the cost of the product and undesirably add to the weight of the conventional folding table.

The present invention is directed to overcoming one or more of the problems discussed above.

SUMMARY OF THE INVENTION

In one aspect, the present invention provides a folding table having a table top and at least a pair of leg assemblies which are pivotable about parallel horizontal axes between a first orientation at which the leg assemblies extend downward from the underside of the table top and a second orientation at which the leg assemblies extend along the underside of the table. The table top is a body of molded plastic material having a pair of sockets integrally formed in the underside of the body of material at the location of each of the leg assemblies. The pair of sockets are at opposite sides of the table and have colinear horizontal passages which extend into the material of the table top. Each of the leg assemblies has a pair of colinear pivot axle projections which extend into the passages of the sockets at opposite sides of the table to couple the leg assemblies directly to the table top.

In another aspect of the invention, a first of the pivot axle projections extends into a first of the socket passages for a first predetermined distance and the other pivot axle projection extends into the other socket passage for a second predetermined distance. At least one of the passages has a depth that is at least as great as the first predetermined distance combined with the second predetermined distance. This enables the projections to be entered into tie passages by inserting one projection deeply into the one passage and then partially withdrawing that projection as the other projection is guided into the other passage.

In a further aspect of the invention, the socket passages have a diameter which is greater than the diameter of the pivot axle projections and a cylindrical bushing is disposed in each of the passages in coaxial relationship with the one of the pivot axle projections that extends into the passage. In addition to providing a wear resistant bearing surface, this also facilitates assembly of the table. The pivot axle projections are entered into the socket passages prior to installation of the bushings and may therefor be canted slightly during the initial insertion of a pivot axle projection.

In another aspect of the invention, the body of molded plastic material forming the table top includes an outer shell of non-cellular plastic and a porous filling of hardened plastic foam.

In a further aspect of the invention, a folding table includes a table top formed by an integral body of molded plastic material, the body having first and second pairs of spaced apart sockets formed in the underside of the body of material. The first pair of sockets have colinear horizontally directed first passages which define a first pivot axis that extends between the first pair of sockets. The second pair of sockets have colinear horizontally directed second passages that define a second pivot axis which is parallel to the first pivot axis. A first pivotable leg assembly has a first pair of colinear pivot axle projections each of which extends into a separate one of the first passages. The combined distances that the first pair of axle projections extend into the first passages is equal to or less than the depth of at least one of the first passages. A second pivotable leg assembly has a second pair of colinear pivot axle projections that extend into the second passages in a similar arrangement. Means are provided for preventing axial movement of the pivot axle projections along the passages after the projections have been inserted into the sockets.

In still another aspect, the invention provides a method of fabricating a folding table. Steps in the method include molding an integral table top from plastic material including forming a first pair of spaced apart sockets on the underside of the table top which have horizontal colinear passages and forming a second pair of spaced apart sockets on the underside which have horizontal colinear passages that are parallel to the passages of the first sockets. First and second leg assemblies are formed and each such assembly is provided with a pair of colinear pivot axle projections that have a smaller diameter than the passages. The first leg assembly is coupled to the first pair of sockets and the second leg assembly is coupled to the second pair of sockets by further steps which include disposing a cylindrical bushing on each pivot axle projection of the leg assembly in encircling relationship with the projection. One of the pivot axle projections of the leg assembly is then inserted into the passage of one of the pair of sockets and is then partially withdrawn from that passage while the other pivot axle projection is guided into the passage of the other socket. The bushings are then slid along the projections and entered into the passages. The method includes the additional step of preventing further axial movement of the projections and bushings relative to the passage.

A folding table embodying the invention does not require the fastening of hinges, brackets or other hardware to the table top for the purpose of coupling pivotable legs to the table top. In the preferred form, the table top has a molded shell of high strength non-porous plastic enclosing a light weight core of hardened foam and sockets for journaling the pivotable leg assemblies are integrally formed in the table top. The invention provides a strong, durable and structurally simple folding table which exhibits a high degree of rigidity when in the extended configuration and which can be quickly and economically assembled.

The invention, together with further aspects and advantages thereof, may be further understood by reference to the following description of the preferred embodiments and by reference to the accompanying drawings.

DETAILED DESCRIPTION OF THE PREFERRED EMBODIMENTS

Figure 1:
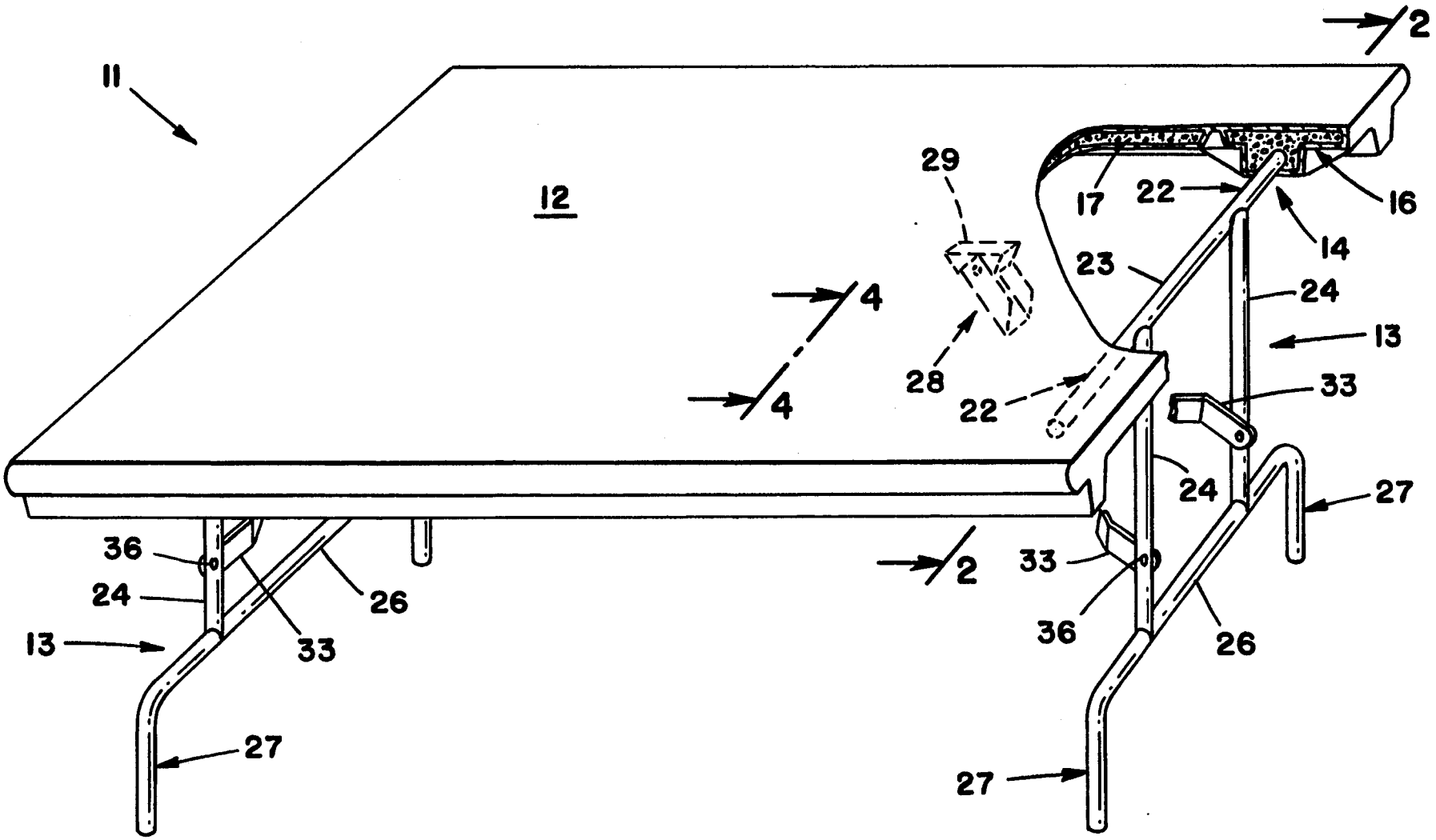
FIG. 1 is a broken out perspective view of a folding table in accordance with the preferred embodiment of the invention.

Referring initially to FIG. 1 of the drawings, a folding table 11 in accordance with this embodiment of the invention includes a table top 12 and a pair of pivotable leg assemblies 13 which are situated near opposite ends of the table. The leg assemblies 13 are directly coupled to table top 12 at sockets 14 which are integrally formed in the the table top material as will hereinafter be described in more detail.

The table top 12 of this particular example has a rectangular shape but can variously be round, oval or have some other configuration.

Figures 2, 3, 4, 5:
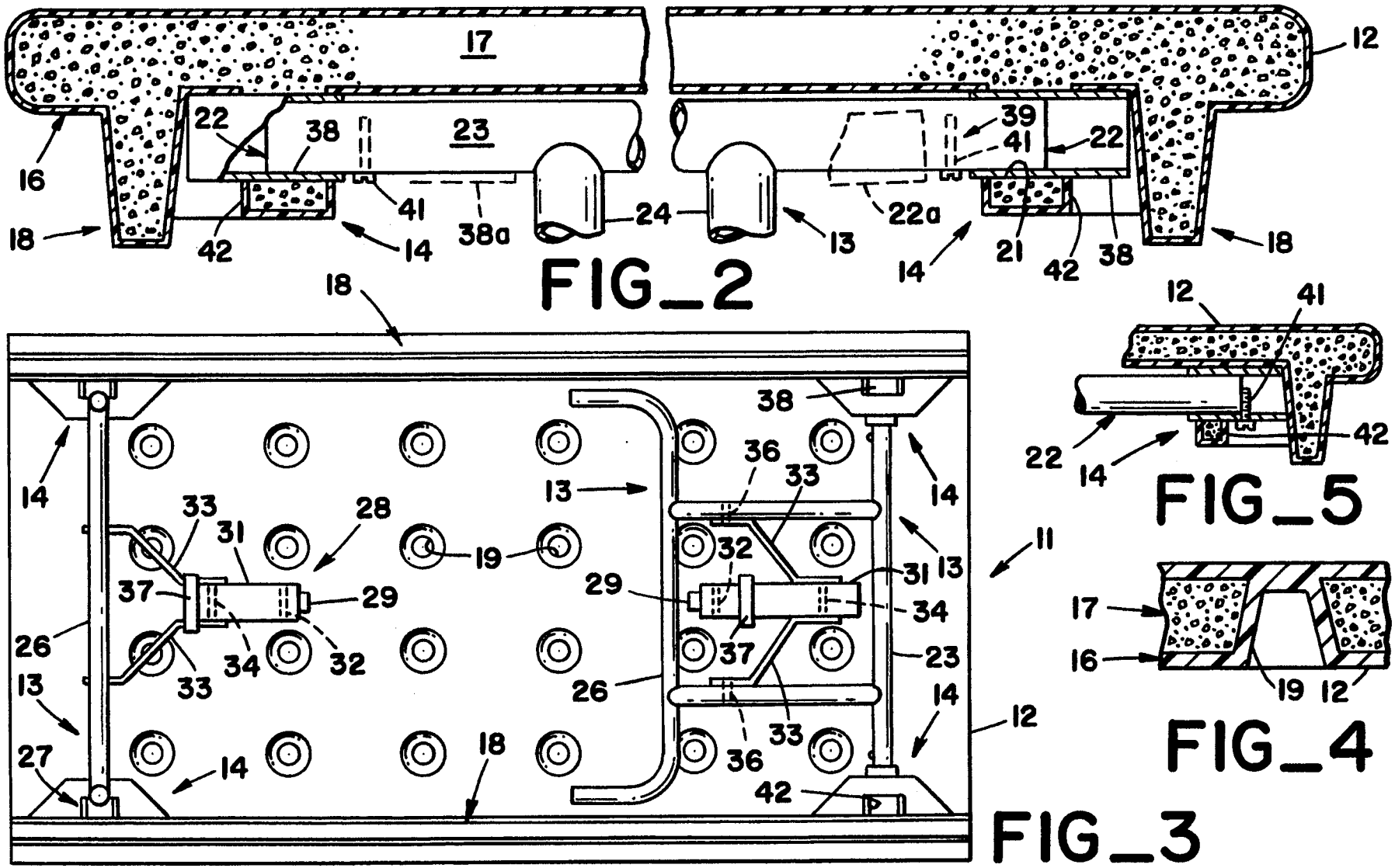
FIG. 2 is a cross section view of a portion of the table of FIG. 1 taken along line 2—2 thereof.
FIG. 3 is a view of the underside of the table of FIG. 1 with one leg assembly in the extended or operative position and the other leg assembly in the folded or storage position.
FIG. 4 is a partial cross section view of the table top of the table of FIG. 1 taken along line 4—4 thereof.
FIG. 5 is a cross section view of a variation of the structure which couples a leg assembly to the table top.

Referring jointly to FIGS. 2 and 3, table top 12 is a unitary body of molded plastic and in the preferred form has an outer shell 16 formed of a high strength non-porous plastic of one of the known forms which encloses an inner core or filling 17 of porous hardened plastic foam which may also be of one of the known types. Techniques for molding plastics into desired shapes such as that of the table top 12 are known to the art.

Strength and rigidity of the table top 12 may be enhanced by forming integral ribs 18 along at least portions of the peripheral region of the underside of the table top which ribs are of greater vertical thickness than the more central regions of the table top. In the present example, a pair of such ribs 18 extend in parallel relationship along opposite side regions of the table top 12. Referring to FIGS. 3 and 4, table top 12 is further strengthened in this example by forming the outer shell 16 to have an array of spaced apart hollow conical regions 19 which extend up through the core 17 material to join with the portion of the outer shell that defines the top surface of the table top 12.

Referring again to FIGS. 2 and 3, the portions of the table top 12 which form sockets 14 extend downward further than the central regions of the table top and are situated adjacent the inner surfaces of ribs 18 at the end regions of the undersurface of the table top. The pair of sockets 14 at each end region of the table 11 have horizontally directed colinear passages 21 which jointly define a pivot axis for an associated one of the two leg assemblies 13.

The leg assemblies 13 may have any of a variety of forms except insofar as each such assembly has a pair of colinear, horizontally directed pivot axle projections 22 that extend in opposite directions from the upper corners of the assembly and which are proportioned to enter into the pair of socket passages 21 at one end region of the table 11.

The pivot axle projections 22 in the present example are opposite end portions of a horizontal tubular frame member 23 that forms the top of the leg assembly 13. In other constructions, the two projections 22 may be separate members that are connected only indirectly by other portions of the leg assembly. In the present example, with reference to FIG. 1, further components of each leg assembly 13 include two spaced apart vertical tubular frame members 24 which extend down from member 23 to a tubular horizontally extending lower member 26. Lower member 26 has end regions which curve down into a vertical orientation to define spaced apart legs 27 for one end of the table 11.

Referring to FIGS. 1 and 3 in conjunction, means 28 are provided for latching the leg assemblies 13 at the extended or vertical orientation of the assemblies. In this embodiment of the invention, the table top 12 is formed with a pair of integral bosses 29 which extend a small distance downward at the underside of the table top at locations which are under the centerline of the table 11 and which are closer to the center of the table than the sockets 14. Each of the latching means 28 has a channel member 31 which is pivoted to a boss 29 by a pivot coupling 32 and which extends towards the leg assembly 13 with which it operates. Each of the latching means 28 further includes a pair of angled arms 33 pivoted to the channel member 31, at a location near the free end of the member, by another coupling 34. The angled arms 33 extend outwardly from opposite sides of the channel member 31 and are pivoted to the vertical frame members 24 by additional pivot couplings 36. Each channel member 31 extends through a slidable rectangular frame 37 which functions as a latch.

Pivoting of a leg assembly 13 into its downwardly directed orientation, as depicted at the left side of FIG. 3, brings the channel member 31 and arms 33 into a coplanar relationship at which the member and arms constitute a diagonal brace extending from boss 29 to the leg assembly. The mechanism may then be locked into this relationship by sliding latch 37 to the free end of member 31 at which position it clasps arms 33 as well as member 31 and prevents pivoting movement at coupling 34. This in turn prevents any further pivoting movement of the leg assembly 13 in either direction.

The latching means 28 is unlocked, when table 11 is to be stored or transported, by sliding the latch 37 back along channel member 31 towards boss 29. This re-enables pivoting of arms 33 relative to member 31 and thus the leg assembly 13 may be folded up into an orientation at which it extends along the underside of table top 12 as shown at the right side of FIG. 3.

Referring again to FIG. 2, coupling of the leg assemblies 13 to the table top 12 by means of the previously described built-in sockets 14 and pivot axle projections 22 is enabled by establishing certain relationships between the proportions of such components. As previously pointed out, the passages 21 of the sockets 14 have a diameter that is greater than the diameter of the pivot axle projections 22. The projections 22 of each leg assembly 13 extend into the pair of socket passages for predetermined distances which are preferably equal distances although that is not essential. At least one and preferably both of the socket passages 21 have a depth which is at least equal to the combined distances that the two projections 22 extend into the two socket passages.

Given the above described relationships of the sockets 14 and projections 22, assembly of the table 11 may be accomplished in accordance with the method of the invention by positioning a cylindrical bushing 38 on each of the projections and sliding the bushings well away from the ends of the projections to the locations designated by dashed lines 38*a* in FIG. 2. One of the projections 22 is then inserted into the socket passage 21 in which it is to be engaged. This is made possible by the difference in the diameters of the projection 22 and passage 21 as the projection may initially be canted slightly as indicated by dashed line 22*a* to enable insertion of that projection while the other projection remains outside of the other socket passage.

The projection 22 is initially inserted into the socket passage 21 to a depth sufficient to enable the other projection to be brought into alignment with the other socket passage. The inserted projection 22 is then partially withdrawn from its passage 21 while the other projection is guided into its passage.

Further steps in the method of assembly include sliding bushings 38 along the inserted projections 22 and into socket passages 21 and preventing further axial movement of the projections and bushings relative to the passages. Means 39 for preventing such movement in this embodiment include threaded screws 41 which function as leg assembly retainers. At least one of the screws 41 is engaged in each projection 22 at a location adjacent the end of the associated bushing 38 and has a head with extends radially from the projection in position to block axial movement of the projection into the seated bushing.

Alternately, with reference to FIG. 5, the sockets 14 may be formed with openings 42 that extend up to intersect the socket passages 21 and the threaded screws 41 may be engaged in the bushings 38 in position to abut the ends of the pivot axle projections 22 within the bushings.

Referring again to FIG. 2, the openings 42 in the sockets 14 are are also advantageous in connection with the first described embodiment in which the screws 41 are situated outside the sockets. Such openings 42 facilitate removal of the bushings 38 from passages 21 in the event that it is desired to disassemble the apparatus for repairs or replacement of parts.

As previously pointed out, only one of the socket passages 21 needs to be sufficiently deep to enable the above described insertion and partial withdrawal of one of the pivot axle projections during the assembly process. In the present preferred embodiment all passages 21 have a depth sufficient for the purpose to provide for a symmetrical construction with similar components at both sides of the table 11.

While the invention has been described with reference to certain preferred embodiments for purposes of example, many modifications and variations of the table construction are possible and it is not intended to limit the invention except as defined in the following claims.

We claim:

1. In a folding table which includes a table top and at least a pair of leg assemblies which are pivotable about parallel spaced apart horizontal axes that define a plane, said leg assemblies being pivotable between a first orientation at which said leg assemblies extend downward from the underside of said table top and a second orientation at which said leg assemblies extend along said underside of said table, the improvement comprising:

said table top being a body of molded plastic material having a flat central region and a pair of downwardly extending socket regions at said underside thereof at the location of each of said leg assemblies, said socket regions being integral portions of said body of molded plastic material that are of greater thickness in the vertical direction than said central region of said body of molded plastic material, wherein the portions of said socket regions which are situated at the plane defined by said parallel axes extend horizontally along said underside of said table top in each of two orthogonal directions for distances that exceed said thickness of said central region, said pair of socket regions being spaced apart and being at opposite sides of said table and having spaced apart collinear horizontal socket passages which extend into said material of said table top at said spaced apart socket regions, and wherein each of said leg assemblies has a pair of horizontally directed colinear pivot axle projections having end portions which extend into said socket passages at opposite sides of said table to couple said leg assemblies directly to said table top.

2. In a folding table which includes a table top and at least a pair of leg assemblies which are pivotable about parallel spaced apart horizontal axes between a first orientation at which said leg assemblies extend downward from the underside of said table top and a second orientation at which said leg assemblies extend along said underside of said table improvement comprising:

said table top being a body of molded of plastic material having a pair of sockets integrally formed in said underside thereof at the location of each of said leg assemblies, said pair of sockets being at opposite sides of said table and having colinear horizontal passages which extend into said material of said table top, and wherein each of said leg assemblies has a pair of horizontally directed colinear pivot axle projections which extend into said passages of said sockets at opposite sides of said table to couple said leg assemblies directly to said table top, wherein a first of said pivot axle projections extends into a first of said passages for a first predetermined distance and the other of said pivot axle projections extends into the other of said passages for a second predetermined distance, and wherein at least one of said passages has a depth that is at least as great as said first predetermined distance combined with said second predetermined distance whereby said pivot axle projections may be entered into said passages by inserting one of said pivot axle projections into said one of said passages and then partially withdrawing said one pivot axle projection as the other of said pivot axle projections is guided into the other of said passages.

3. The folding table of claim 2 further including means for preventing axial movement of said pivot axle projections following insertion thereof into said passages.

4. In a folding table which includes a table top and at least a pair of leg assemblies which are pivotable about parallel spaced apart horizontal axes between a first orientation at which said leg assemblies extend downward from the underside of said table top and a second orientation at which said leg assemblies extend along said underside of said table the improvement comprising:

said table top being a body of molded plastic material having a pair of sockets integrally formed in said underside thereof at the location of each of said leg assemblies, said pair of sockets being at opposite sides of said table and having colinear horizontal passages which extend into said material of said table top, and wherein each of said leg assemblies has a pair of horizontally directed colinear pivot axle projections which extend into said passages of said sockets at opposite sides of said table to couple said leg assemblies directly to said table top, wherein said pivot axle projections extend into said socket passages for the same distance and wherein at least one of said passages has a depth that is at least twice said distance.

5. The folding table of claim 2 wherein said socket passages have a diameter which is greater than the diameter of said pivot axle projections, further including a pair of cylindrical bushings each being disposed in a separate one of said passages in coaxial relationship with the one of said pivot axle projections that extends therein further including a pair of leg assembly retainers each of which extends radially from a separate one of said pivot axle projections at locations which are adjacent the ends of said bushings.

6. In a folding table which includes a table top and at least a pair of leg assemblies which are pivotable about parallel spaced apart horizontal axes between a first orientation at which said leg assemblies extend downward from the underside of said table top and a second orientation at which said leg assemblies extend along said underside of said table, the improvement comprising:

said table top being a body of molded plastic material having a pair of sockets integrally formed in said underside thereof at the location of each of said leg assemblies, said pair of sockets being at opposite sides of said table and having colinear horizontal passages which extend into said material of said table top, and wherein each of said leg assemblies has a pair of horizontally directed colinear pivot axle projections which extend into said passages of said sockets at opposite sides of said table to couple said leg assemblies directly to said table top, wherein said socket passages have a diameter which is greater than the diameter of said pivot axle projections, further including a pair of cylindrical bushings each being disposed in a separate one of said passages in coaxial relationship with the one of said pivot axle projections that extends therein and a pair of leg assembly retainers each of which extends radially from a separate one of said pivot axle projections at locations which are adjacent the ends of said bushings and wherein said leg assembly retainers are threaded screws engaged with said pivot axle projections.

7. In a folding table which includes a table top and at least a pair of leg assemblies which are pivotable about parallel spaced apart horizontal axes between a first orientation at which said leg assemblies extend downward from the underside of said table top and a second orientation at which said leg assemblies extend along said underside of said table, the improvement comprising:

said table top being a body of molded plastic material having pair of sockets integrally formed in said underside thereof at the location of each of said leg assemblies, said pair of sockets being at opposite sides of said table and having colinear horizontal passages which extend into said material of said table top, and wherein each of said leg assemblies has a pair of horizontally directed colinear pivot axle projections which extend into said passages of said sockets at opposite sides of said table to couple said leg assemblies directly to said table top, and wherein said socket passages have a diameter which is greater than the diameter of said pivot axle projections, further including a pair of cylindrical bushings each being disposed in a separate one of said passages in coaxial relationship with the one of said pivot axle projections that extends therein and a pair of threaded screws each of which extends radially through a separate one of said bushings and into the one of said pivot axle projections that is situated therein.

8. The folding table of claim 1 wherein said socket passages have a diameter which is greater than the diameter of said pivot axle projections, further including a pair of cylindrical bushings each being disposed in a separate one of said passages in coaxial relationship with the one of said pivot axle projections that extends therein, and wherein said table top has a plurality of openings in said body of molded plastic material each of which extends up from said underside thereof within a separate one of said socket regions to intersect a separate one of said passages at the location of the inner end of the bushing that is situated in the passage.

9. A folding table comprising:

a table top formed by an integral body of molded plastic material, said body have a first pair of spaced apart sockets formed in said body of material and which are situated at opposite sides of the underside thereof, said first pair of sockets having colinear horizontally directed first passages which define a first pivot axis that extends between said first sockets, and further having a second pair of spaced apart sockets formed in said body of material at opposite sides of said underside thereof, said second pair of sockets having colinear horizontally directed second passages which define a second pivot axis that extends between said second sockets and which is parallel to said first pivot axis, a first pivotable leg assembly having a first pair of horizontal colinear pivot axle projections each of which extends into a separate one of said first passages, the combined distances that said first pair of axle projections extend into said first passages being equal to or less than the depth of at least one of said first passages, a second pivotable leg assembly having a second pair of horizontal colinear pivot axle projections each of which extends into a separate one of said second passages, the combined distances that said second pair of pivot axle projections extend into said second passages being equal to or less than the depth of at least one of said second passages, and means for preventing axial movement of said pivot axle projections along said passages after insertion of said pivot axle projections into said sockets.

10. The folding table of claim 9 wherein said passages formed in said body of material have an inside diameter that exceeds the outside diameter of said pivot axle projections, further including a plurality of cylindrical bushings each being disposed in a separate one of said passages in coaxial relationship with the pivot axle projection that extends therein, and wherein said means for preventing axial movement also prevents axial movement of said bushings.

11. In a method of fabricating a folding table, the steps comprising:

molding an integral table top from plastic material including forming a first pair of spaced apart sockets on the underside of the table top which have horizontal colinear passages and forming a second pair of spaced apart socket on the underside of the table top which also have horizontal colinear passages that are parallel to said passages of said first sockets, forming first and second leg assemblies including providing each such leg assembly with a pair of spaced apart horizontal colinear pivot axle projections that have a smaller diameter than said passages, coupling said first leg assembly to said first pair of sockets and coupling said second leg assembly to said second pair of sockets by the further steps of disposing a cylindrical bushing on each of the pivot axle projections of the leg assembly in encircling relationship with the pivot axle projection, inserting one of the pivot axle projections of the leg assembly into the passage of one of the pair of sockets and then partially withdrawing the one pivot axle projection from that passage while guiding the other pivot axle projection of the leg assembly into the passage of the other of the pair of sockets, sliding said bushings along said pivot axle projections into the socket passages, and preventing further axial movement of said pivot axle projections and said bushings relative to said passages.

* * * * *